US011439872B2

(12) United States Patent
Lee

(10) Patent No.: US 11,439,872 B2
(45) Date of Patent: Sep. 13, 2022

(54) SWIM FIN

(71) Applicant: Daniel Gerous Lee, Reno, NV (US)

(72) Inventor: Daniel Gerous Lee, Reno, NV (US)

(73) Assignee: Daniel Gerous Lee, Reno, NV (US)

( * ) Notice: Subject to any disclaimer, the term of this patent is extended or adjusted under 35 U.S.C. 154(b) by 207 days.

(21) Appl. No.: 17/081,849

(22) Filed: Oct. 27, 2020

(65) Prior Publication Data

US 2022/0126172 A1 Apr. 28, 2022

(51) Int. Cl.
*A63B 31/11* (2006.01)

(52) U.S. Cl.
CPC ..... *A63B 31/11* (2013.01); *A63B 2031/115* (2013.01)

(58) Field of Classification Search
CPC .... A63B 31/00; A63B 31/11; A63B 2031/115
USPC ..... 441/64
See application file for complete search history.

(56) References Cited

U.S. PATENT DOCUMENTS 6,371,821 B1 * 4/2002 McCarthy ..... A63B 31/11 441/64
9,764,192 B1 * 9/2017 Maresh ..... A63B 31/11
10,525,307 B1 * 1/2020 Maresh ..... A63B 31/11
11,135,480 B2 * 10/2021 Maresh ..... A63B 31/11

* cited by examiner

*Primary Examiner* — Lars A Olson

(57) ABSTRACT

A swim fin or pair of fins, and method of providing omni directional thrust propulsion during a swimmer/users, power cycle relative to range of motion, that may comprise of, elastomeric flexible to rigid and/or composite materials, a leg bracket, accompanied by leg strap, ankle strap, and attaching hardware, a foot pocket comprising a plurality of pressure entrapment orifices, and fixably attached orifice flaps, disposed dorsally about a foot pocket, a fin blade extending outwardly of said foot pocket, comprising a plurality of fin blade orifice, fixably attached orifice flaps disposed about said fin blade. Sockets, with attaching hardware, disposed about the edges of said fin blade, having removably attached articulating socketed and non-socketed jointed members that extend along the medial to lateral edges as well as anteriorly from said fin blade edges, articulating members may include, integral joint sections having separately assembled internal hardwares, along with corresponding removably attached cable/tendon hardware, which is routed from said lower leg bracket, internally through the fin blade body, to the interior of said socket sections, and removably attached to articulating members, outwardly about the swim fin assembly, a swim fin may further include a fixably attached webbing comprising of thin flexible materials, disposed between said articulating members and fin blade edges, for a uniquely improved method of hydrodynamic pressure entrapment, for the advantage of uniquely increased angle of attack propulsion method for a given user in water.

5 Claims, 10 Drawing Sheets

SWIM FIN

FIELD OF INVENTION

The present invention relates to a swim fin or a pair of swim fins thereof and more particularly to an improved swim fin having pressure entrapment method and articulation for multiple angles of attack for a swimmer/user to be utilize in a fluid medium/water.

BACKGROUND

Swim fins are used by swimmers, body surfers, divers, and others in water to improve propulsion, speed and water agility, swim fin design that combine a foot pocket with side rails or fin blade section are commercially available. The objective of a swim fin is to provide maximum propulsion and agility while minimizing the work preformed by a given swimmer. This may be accomplished by optimizing the angle of attack of a swim fin during kick cycles power stroke of a swimmer, propelling said swimmer through a fluid medium. Typically swim fins, currently available are either too rigid or too flexible for a given use, or have a contour or profile that result in inefficient hydrodynamics, wherein fluid and fluid pressure, escape the main body and sides of a fin blade, resulting in the generation of vortices, that may negate propulsive forces, resulting in a decrease of efficiency, corresponding fatigue, and discomfort of a given user therein. Therefor to optimum propulsion and comfort, it is desired for hydrodynamic forces to be either reduced or entrapped for maximum laminar flow efficiency and essentially free of excess turbulence.

In prior art the angle of attack of a swim fin may be defined as the angle between the line of horizontal attitude and movement of a swimmers leg relative to the position of a swimmer's body position and the lengthwise alignment of a swim fin relative to the horizontal movements known to those with ordinary skill in the art, as a kick cycle, having two directions of potential power stroke, swim fin performance optimized in this manner for various modes of use, for example; prior art may be designed for low, moderate, and aggressive kicking cycles. For recreational or relaxed use, a swim fin or pair of swim fins may be constructed of flexible materials, to provide a horizontally low angle of attack, for low thrust operations, for aggressive kicking cycles, the swim fins may be constructed of stiff material, to provide a greater horizontal thrust operation, relatively an angle of attack may optimize the conversion of horizontal kicking energy of a swimmer, to thrust or propel the user efficiently through water. Aggressive and nonaggressive modes of use, generally require different fin designs and/or different fin material durometers, because optimum fin performance for each mode require mutually exclusive design parameters, other known swim fin designs provide deformable regions, permitting the fin blade to flex about a transverse axis, thus prior art, as it pertains to a swim fin or pair of swim fins are focused primarily in regards to a horizontal aggressive or nonaggressive kick cycle, with regard to the horizontal blade position and not rather to a perpendicular step cycle, relative to the horizontal attitude of a given user's body position in a fluid medium. The present art in this embodiment of a unique swim fin optimize a perpendicular angle of attack, having a pressure reduction and entrapment method through flexible and articulated components resulting in an improved power stroke cycle during a step cycle of a given swimmer/user's propulsion through a fluid medium/water.

BRIEF DESCRIPTION OF DRAWINGS

NOTE: For simplicity of illustration flexible materials, composites, rubbers, plastics, bearing, O-rings, nuts, bolts, screws, washers, and minutiae of common water sport industry hardware and processes fabrication of said industry are not depicted. As they are known to those with skill in the art, when they are shown it is purely for illustrative purposes and not intended to capture the embodiments of the invention disclosed.

The details of the present invention will be readily understood from a detailed description of the preferred embodiments taken in conjunction with the following figures.

DETAILED DESCRIPTION OF INVENTION

The various embodiments and variations thereof, illustrated in the accompanying figures and/or described herein, are merely exemplary and are not meant to limit the scope of the invention. It is to be appreciated, that numerous variations, of the invention have been contemplated, as would be obvious to one, of ordinary skill in the art with the benefit of this disclosure. Rather the scope and breadth afforded the document should only be limited by the claims provided herein, while applying either the plain meaning to each of the terms and phrases in the claims, or the meanings clearly and unambiguously provided in this specification.

Figure 1:
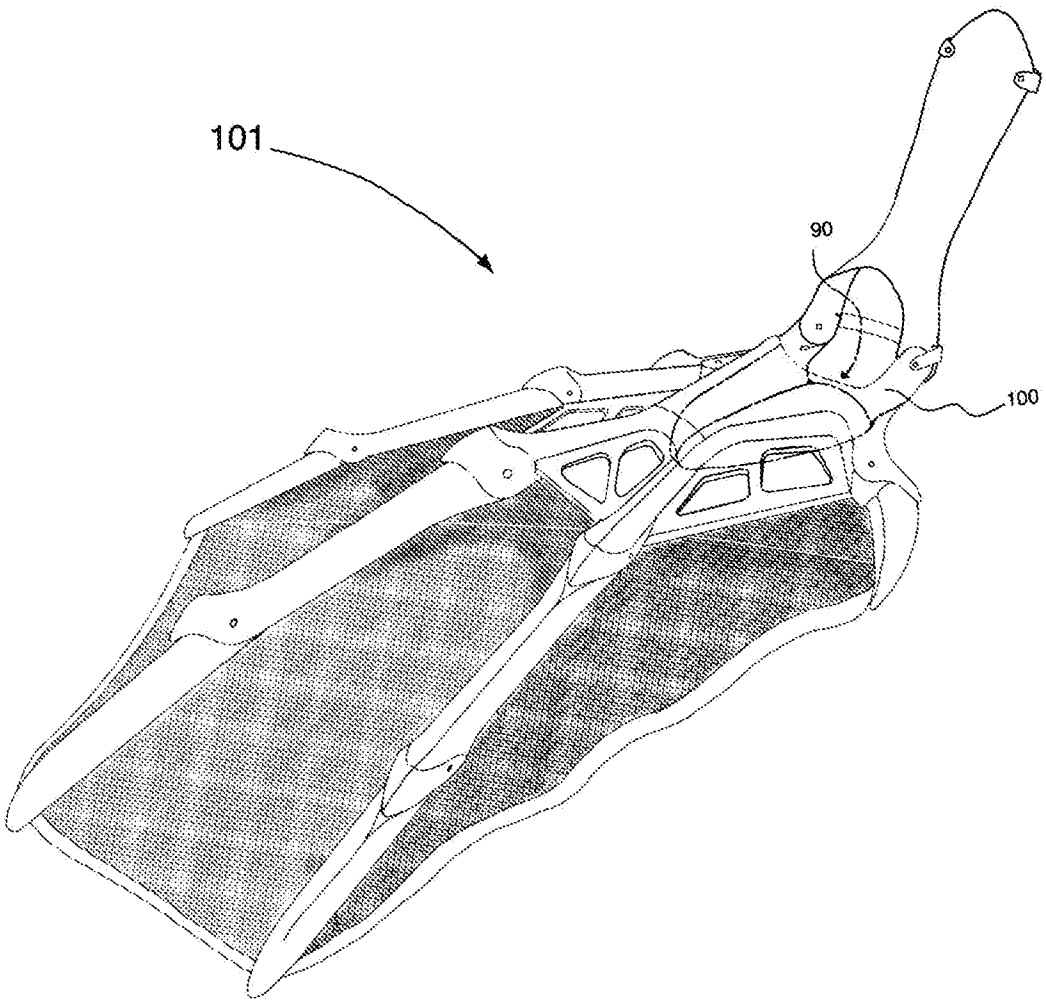
FIG. 1 a prospective view, when a uniquely improved swim fin assembly, according to an embodiment of the present invention is viewed form an upper side.

An embodiment of a uniquely improved swim fin and/or pair of swim fins, and improved angle of attack method:

FIG. 1, view 101 is an embodiment of unique swim fin assembly 100 and is illustrated all or in part in FIGS. 1 to 10.

Referring to FIG. 1, view 101 is an embodiment, illustrated in a prospective view depicting a swim fin assembly 100 viewed from an upward side, that may be molded or otherwise fabricated in a manner known in the art. The swim fin assembly 100 may be formed of flexible to rigid materials, such as rubber, thermoplastic rubber, synthetic composite materials including carbon fiber and/or combination thereof. Wherein a foot pocket 90 is depicted in phantom.

Figure 2:
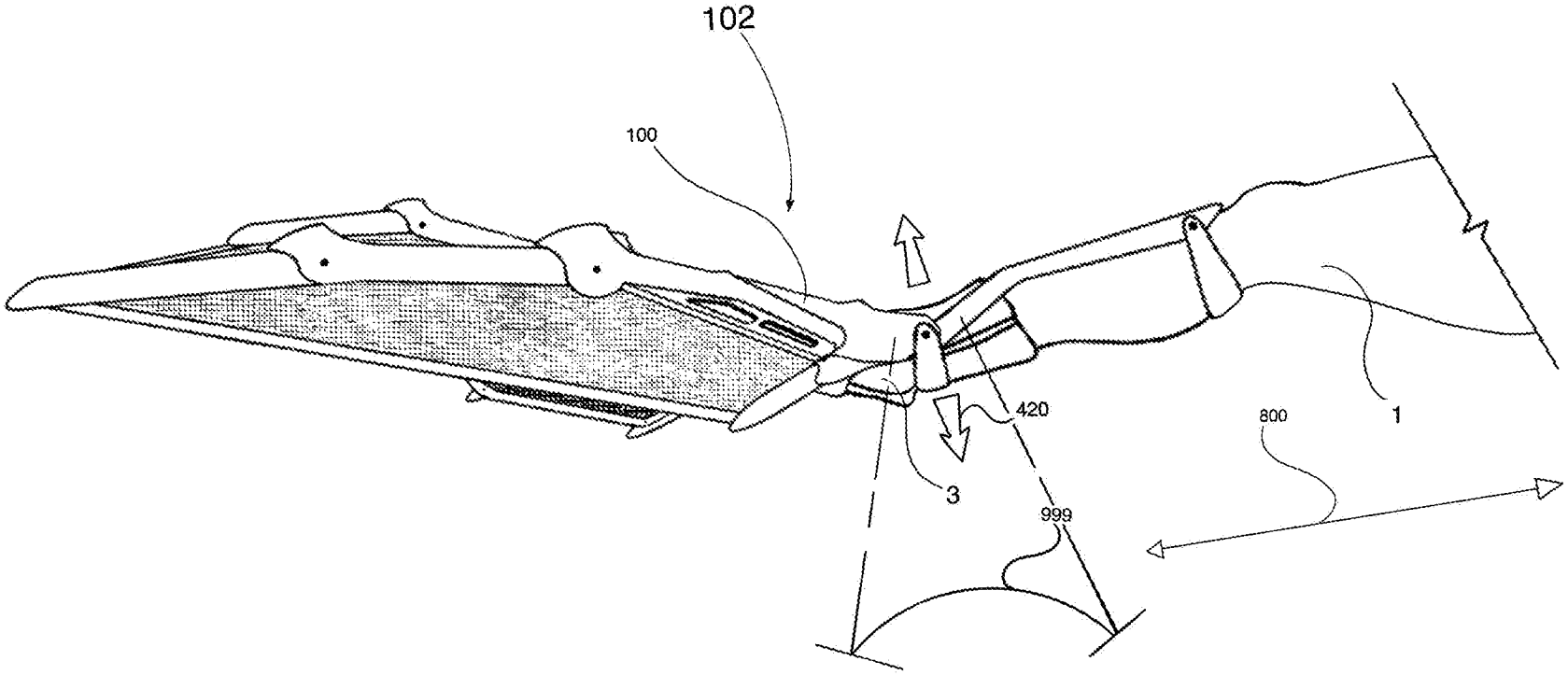
FIG. 2 is an instep profile view, of a swim fin assembly and a swimmer's leg portion.

Referring to FIG. 2, view 102, is an embodiment, illustrated in an instep profile view of a removably attached swim fin assembly 100 to a swimmer/user's leg portion 1 and foot 3, wherein all represented in this embodiment are oriented in a relative horizontal attitude 800 further represented by an angle of rotational flexion 999 about the swim fin assembly 100 and are a commonplace position in current art utilizing horizontal kick cycle/stroke method 420 for propulsion in a fluid medium, as would be known to one with ordinary skill in the art.

Figure 3:
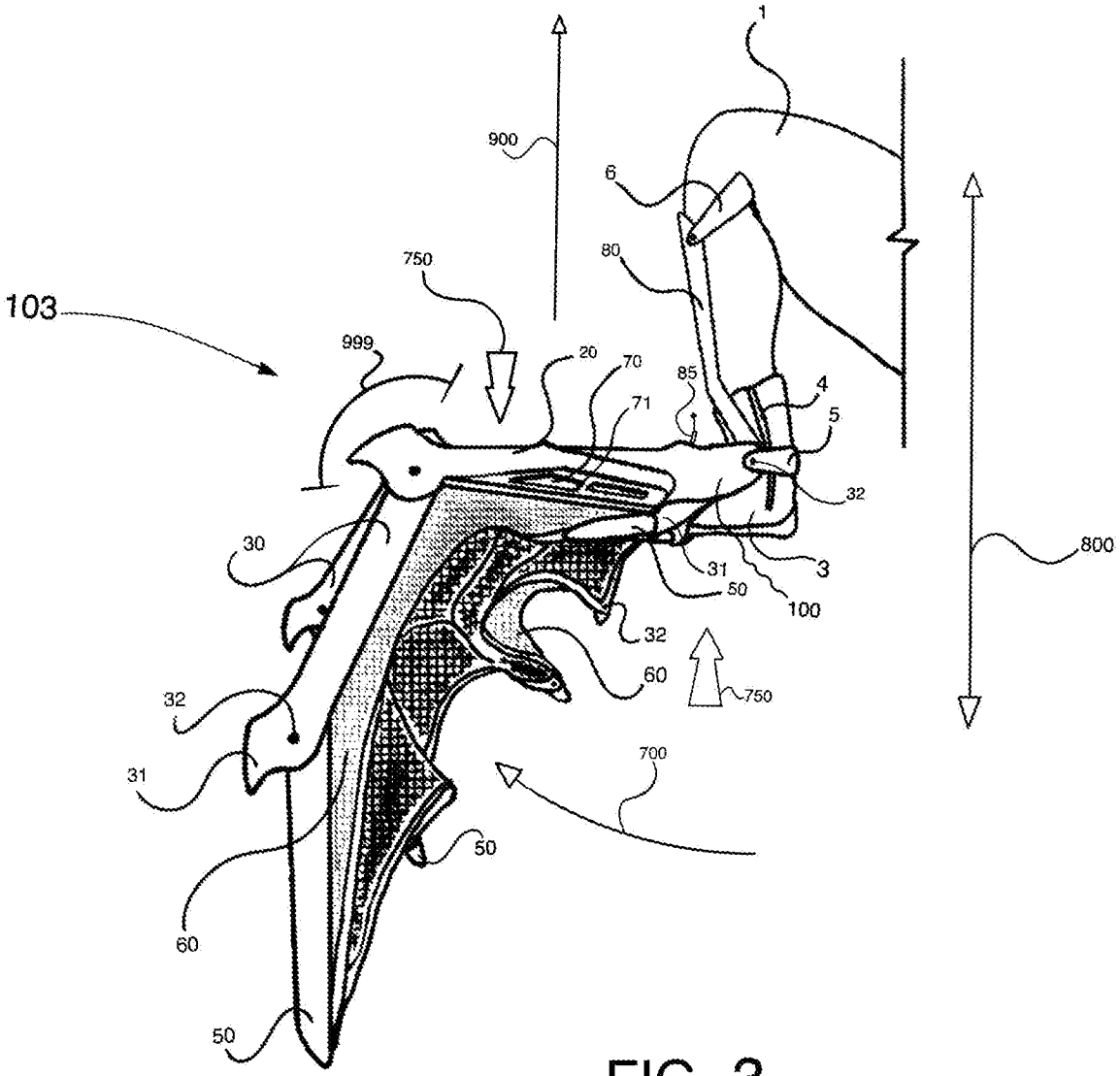
FIG. 3 is an instep profile view, of a swim fin assembly and a swimmer's leg portion.

Referring now to FIG. 3, view 103 is an embodiment illustrated in an instep profile view depicted in a state of detachment herein. Wherein cable/tendon hardware 85 is depicted removed/detached from leg bracket 80 so as to embody pivotal and/or rotational flexions 999 about the swim fin assembly 100. Hereby leg bracket 80, fin blade assembly 20, socketed articulating members 30, and non-socketed articulating members 50 rotate/articulate about said swim fin assembly 100 attach points 33 and attach point hardware 32 herein.

Figure 6:
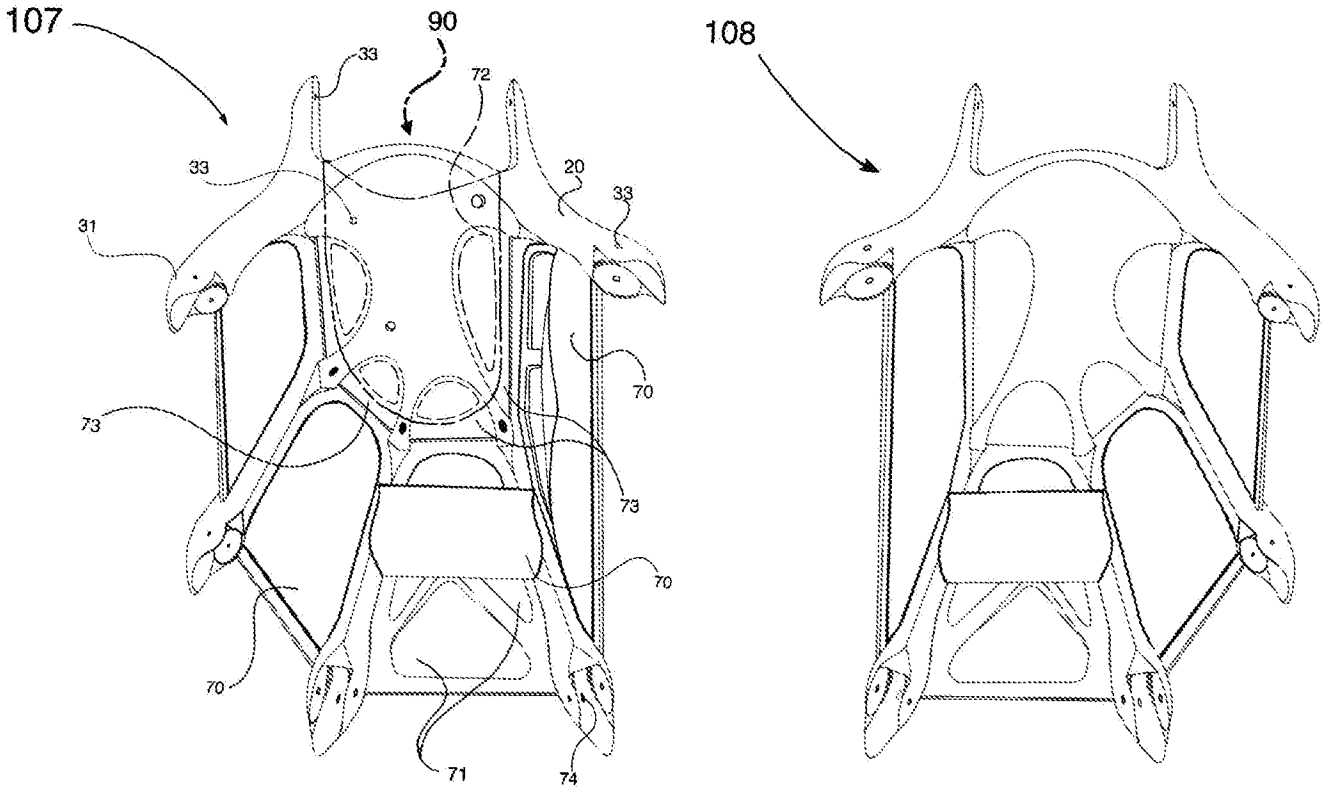
FIG. 6 is a bottom profile view of a pair of fin blade portion.
Figure 8:
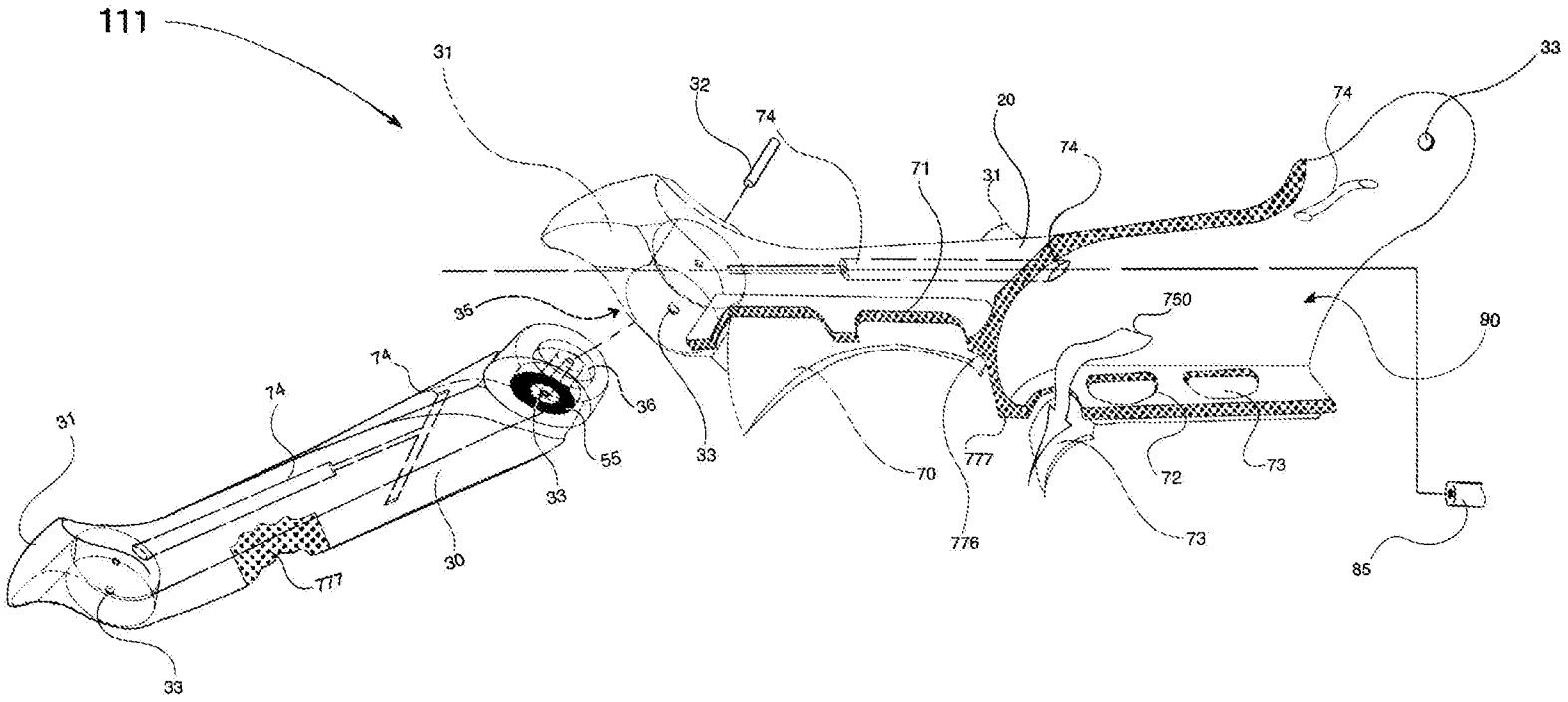
FIG. 8 is a profile cut away view, of a foot pocket, fin blade portion, with corresponding articulating member, detached from fin blade socket.

A swimmer/user's leg portion 1, foot 3, and foot wear 4 are secured inside said foot pocket 90; best represented and depicted in phantom, in FIGS. 1, 6, and 8; as well as secured too said leg bracket 80, by means of removably attached strappings 5 and 6 as is commonly utilized in the art. Moreover as a given swimmer/user creates an upward motion 900, of said leg 1, accompanied by upward flexion 700 of said foot 3, the unique swim fin assembly 100 and said movements of a user creates pressure differentials 750, wherein said fin blade 20 portion uniquely utilizes a plurality of fin blade orifices 71, as well as a plurality of fixably attached orifice flaps 70 comprising flexible material commonly utilized in the art, for the purpose of uniquely alleviating pressure differentials 750, by means of passage through said fin blade orifices 71 disposed about said fin blade 20, wherein an apex of said upward motion 900 and 700 become maximized by a user. Said fin blade orifice flaps 70 come to rest against and overlap said fin blade orifice 71 allowing for pressure entrapment about the plantar/bottom portion of said fin blade.

Furthermore said upward motions 900 and 700 of a swimmer/user, cause articulating members 30 and 50 to rotate about attach points 33 accompanied by webbing 60 comprising of thin flexible material and/or fabrics, to collapse together so as to embody, said rotational flexion/movements 999 about said swim fin assembly 100.

Referring to FIGS. 2, and 3 for a comparison. Referring firstly to FIG. 2, view 102, is an embodiment of a swimmer's leg 1, foot 3, and a unique swim fin assembly 100, in a horizontal attitude 800 for a horizontal angle of attack 420. Wherein a given swimmer utilizes a kick stroke 420, in this embodiment, said swimmer's foot 3, is executing a plantar flexion, that is commonly utilized in current art, for the purpose of horizontal kick strokes for a given swimmers propulsion moving about in a fluid medium and would be obvious to one with ordinary skill in the art, and again for comparison, referring now to FIG. 3, view 103, in this embodiment said swimmer's said leg 1, foot wear 4, foot 3, and swim fin assembly 100 herein, is represented in an upward flexion 900, with said swimmer/user's foot 3, in a dorsiflexion 700. A swimmer/user in so moving from a said horizontal attitude 800, to said upward flexion attitude 900 and 700 allow a swimmer a more perpendicular angle of attack, wherein this action is not commonly know to those with skill in the art, It is to be understood and known in this preferred embodiment as a step cycle/power stroke 425; best represented in FIG. 4; furthermore this action is Not commonly utilized in current art. Moreover in this attitude said power stoke 425 or action thereof: would be liken to a person's ascent of a flight of stairs/ladder; moreover when this action occurs by a given swimmer/user said fin blade 20, is uniquely equipped with said fin blade orifices 71 and disposed about said fin blade 20, while accompanied by said fin blade orifice flaps 70, fixedly attached to said fin blade 20 surfaces by means of common knowledge in the art, as would be the multitude of configurations thereof, and would be so designed by one of ordinary skill in the art with the benefit of this disclosure; furthermore to be disposed about the bottom of said fin blade orifice's 71 in so allow for the hydrodynamic forces to flow through said fin blade 20 at high volume, whereby allowing reduction of pressure occurring dorsally about said unique swim fin assembly 100. Referring briefly to FIG. 3, view 103, in a previously described, detached state of said swim fin 100, hydrodynamic forces naturally deform, said removably attached articulating members 30, and 50, about their respective sockets 31, disposed about edges of said fin blade 20, in conjunction with the removably attached webbing 60, disposed between articulating members 30, 50, and edges of said fin blade 20, during an upward duration of a said step cycle 425 herein.

Figure 4:
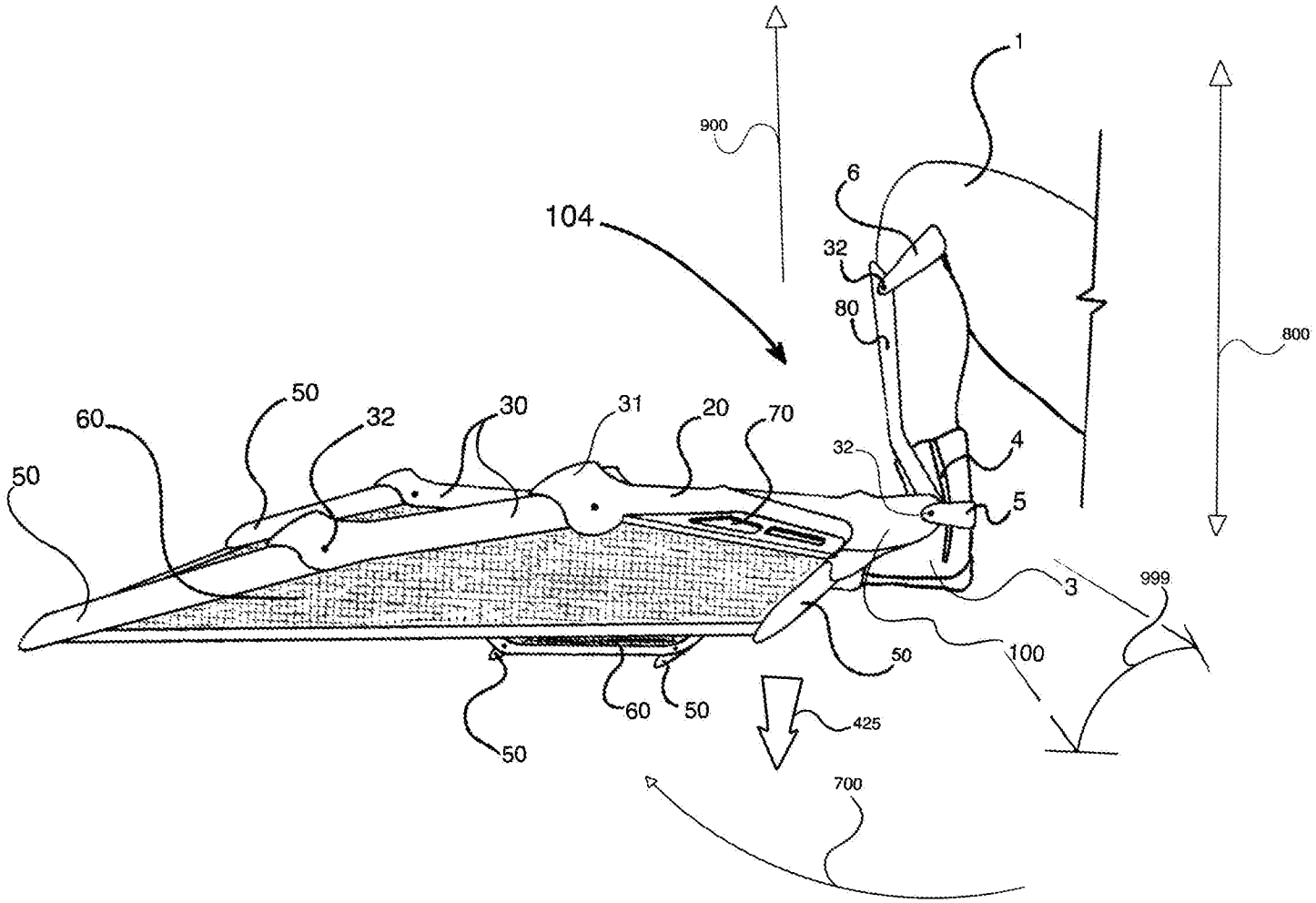
FIG. 4 is an instep profile view, of a swim fin assembly and a swimmer's leg portion.
Figure 5:
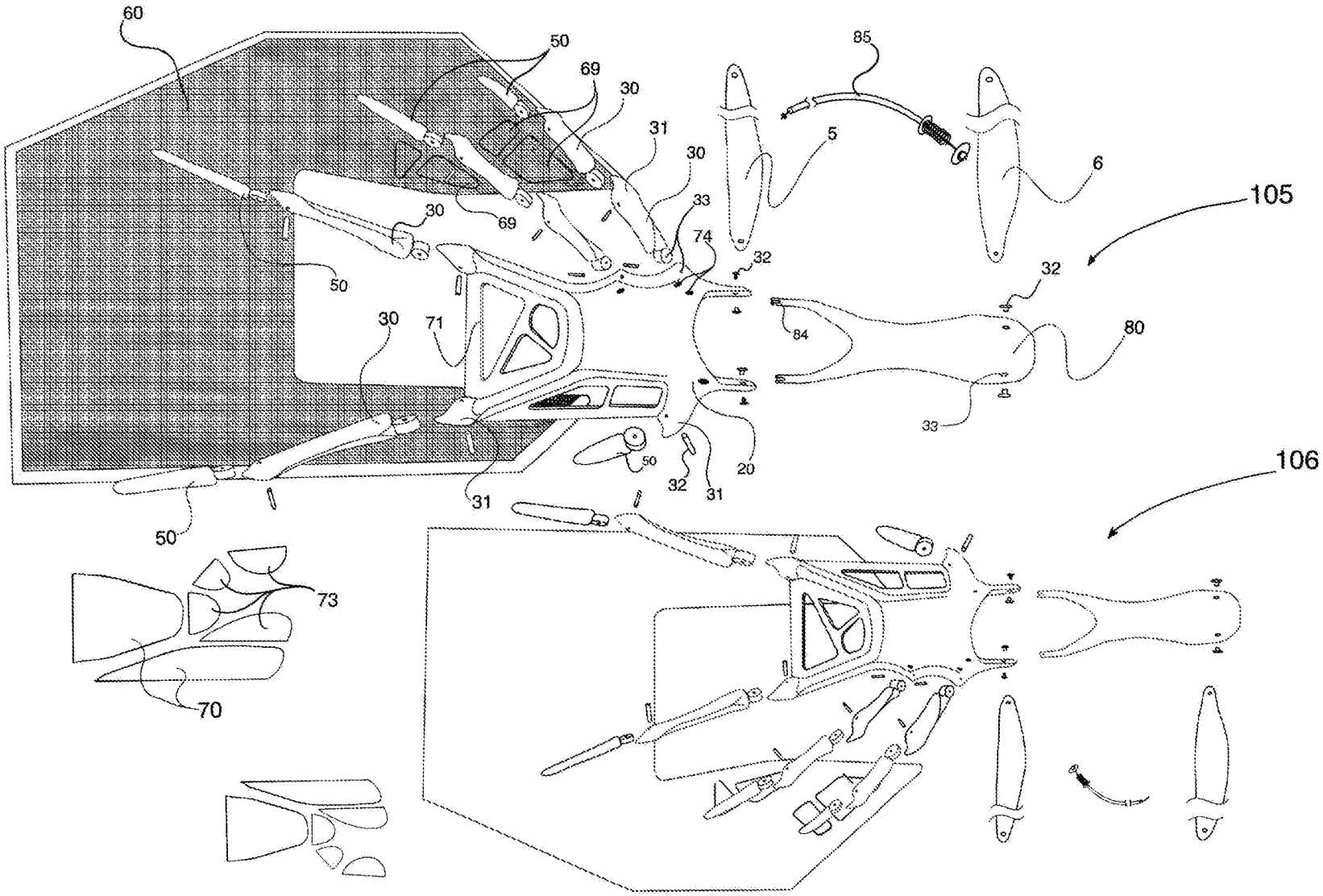
FIG. 5 is an exploded prospective view of swim fin assemblies disassembled.

Referring to FIG. 4, view 104, is an embodiment of a swimmer's leg 1 and fin assembly 100 wherein respective tendon cabling 85, represented herein, is depicted fully attached, to leg bracket 80, about aft foot pocket attach point 32. In this state said swim fin assembly 100, represented out stretched at an apex of previously mentioned flexion positions 900 and 700. Allow turbulent hydrodynamic forces to rest, wherein said fin blade flaps 70, and foot pocket flaps 73; best shown in FIGS. 5-8; said fin blade 20, and foot pocket 90 dorsal surfaces coming to rest against and overlap the bottom side of fin blade orifices 71, as well as foot pocket orifices 72, combined with the uniquely articulated members 30, and 50, webbing 60, leg bracket 80, and cabled tendon hardware 85, herein this combination allows a swimmer/user hydrodynamic advantage, for a more perpendicular, angle of attack relative to the horizontal position 800, during a downward flexion, of a given step cycle 425, allowing for the entrapment of a fluid pressure in so creating propulsion furthermore allowing said user ease of placement of said fin assembly 100, with regard to the omni directional nature, of a given swimmers range of motion, a more focused pressure entrapment advantage while moving about in a fluid medium/water Referring primarily to FIG. 5, view 105, is an embodiment illustrated in an exploded view, of a pair of uniquely improved swim fin assembly 100, and depicted with most basic of components, wherein webbing 60, depicts a variation employing web orifice 69, comprising of flexible material, disposed between articulating members, may be installed for the purpose of pressure entrapment previously describe in this preferred embodiments; Referring to view 106, of this embodiment depicts a counterpart uniquely improved swim fin assembly 100 with the same variations, previously described of its counterpart herein.

Referring to FIG. 6, view 107, is a bottom profile view, of a uniquely improved fin blade 20 wherein foot pocket 90, with orifices 72 are illustrated in phantom, and fixedly attached orifice flaps, at rest about the foot pocket 90, and fixedly attached fin blade 20, fin blade orifices 71, and fixedly attached orifice flaps 70 are disposed about the fin blade 20. Wherein two flaps 70, are illustrated out of a rest orientation, to embody orifice to flap relation, that is uniquely utilized for pressure entrapment of the swim fin assembly 100 previously described in this preferred embodiment herein; now referring to view 108 of this embodiment depicts a uniquely improved swim fin blade 20 wherein its counter part previously described herein are the same by design herein.

Figure 7:
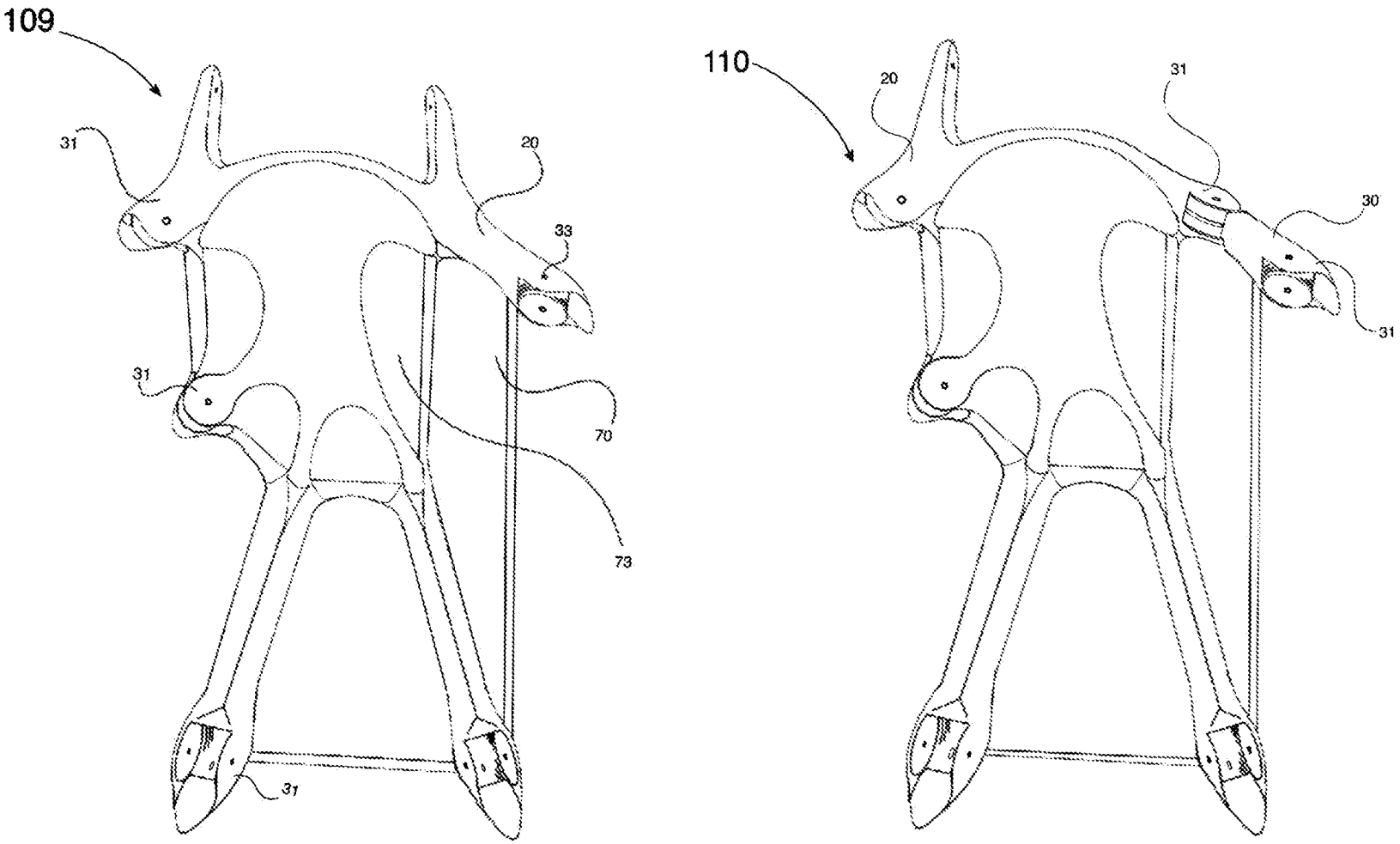
FIG. 7 is a bottom view, of two improved fin blades, view 109, depicting variations of a fin blade portion, view 110, depicting variations, of a fin blade.

Referring to FIG. 7, view 109, is an embodiment of the left fin blade 20, depicting the various variation, of this preferred embodiment, for the purpose of illustrating the plurality of component orientations about the unique swim fin assembly 100 herein; referring now to view 110, of this embodiment depicts the various variation, of this preferred embodiment, for the purpose of illustrating the plurality of component orientations, about the unique swim fin blade 20 herein.

Referring to FIG. 8, view 111, is an embodiment in cutaway view, of the foot pocket 90 and fixedly attached fin blade 20 comprising of flexible materials 777 known to those with ordinary skill in the art, with fixedly attached orifice flaps 73, in a said separated state from socketed articulating member 30 comprising of minutiae through holes 33, 74, socket cavities 35, minutiae cavities 36, and minutiae 55 for purposes previously described in this preferred embodiment herein.

Referring briefly to FIG. 8, view 111, this embodiment illustrates partly assembled cutaway view of a unique swim fin blade 20 accompanied by one socketed articulating member 30 comprising of flexible to rigid materials 777 commercially available and would be known to one with ordinary skill in the art and would be obvious with the benefit of this disclosure.

Figure 9:
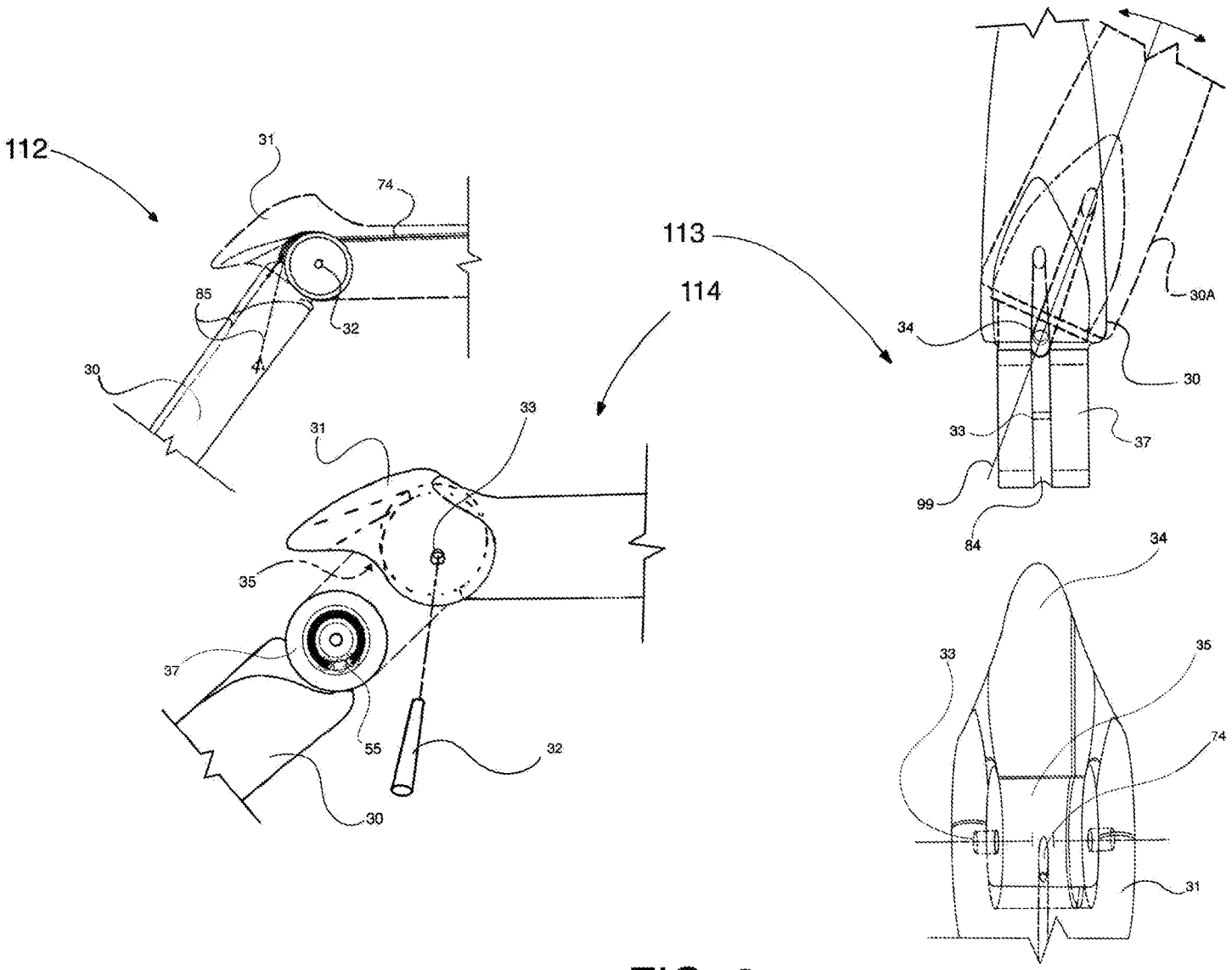
FIG. 9 is a plurality of profile views, view 112 depicts a connected join section; view 113 depicts a joint section detached, viewed from the bottom; view 114 depicts a joint section detached.

Referring to FIG. 9, view 113, is an embodiment illustrating a joint 37, socketed section 31, and corresponding potential duality, of articulating member 30 or 50 about the swim fin assembly 100, in separated state with a potential alternate orientation 99, represented as member 30A illustrated in phantom, moreover for the purpose of uniquely withstanding hydrodynamic stresses, acting on and about the fin assembly 100, in which the socket 31, has a plurality of orientation about previously described fin blade assembly 100, which employs unique composition of elongated lower member support point 34, hardware through holes 33, and 74, a socket cup/cavity 35, to receive an articulating member 30, so as to be attached, to tendon cabling 85, when assembled together, removably attached webbing 60, fore and aft, socket 31, sections, disposed about the dorsal area of the fin assembly 100, Employing this unique socket support 34, to the joint 31, distributes the forces mentioned previously, in conjunction with the webbing 60, tendon 85, and pivotally attached leg bracket 80, in conjunction with respective compositions, about the fin 100, result in a more efficient use of laminar flow, created by all, flexion motions of a given user whereas the member body in a plurality of potential fixably attached orientations 99, where herein minutiae's are shown in phantom; referring now to view 114, a profile view, of a given joint section, representing a separation, wherein attaching hardware 32, and 85, are detached, hereby illustrates socket cup 35, to articulating members 30, or 50, attachment method herein; furthermore referring to view 112, is a profile view of a given joint section 31, representing a connected joint/socket section 37 to 31, whereas the socket cavity 35 is illustrated in phantom, depicting the articulating nature of swim fin assembly 100 portion herein.

Figure 10:
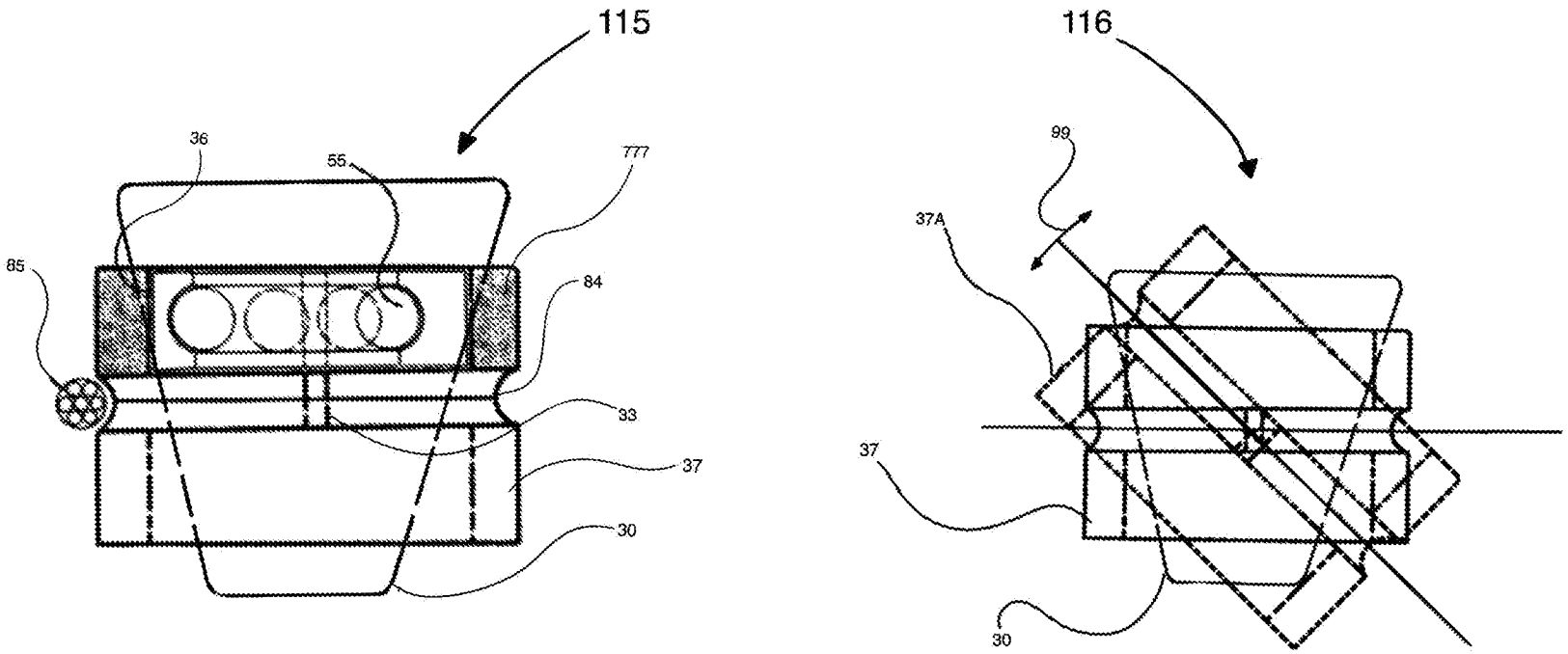
FIG. 10 is a top view, of articulating members portions.

Referring to FIG. 10, view 114, is an embodiment of an articulating member 30 or 50 illustrated in a top view, comprising of hardware through holes 33, minutiae cup 36, and member body 30, illustrated in phantom, wherein minutiae has been installed to minutiae cavity 36, illustrated in a cutaway view, stopping at an edge of its tendon cable channel 84, for the purpose of reducing friction, while accompanied by it's tendon cable 85, represented in a cutaway view, for the purpose of mechanical advantage, as would be understood to those with ordinary skill in the art; referring to FIG. 10, view 115, is an embodiment, of an articulating member 30 or 50 illustrated in a top view showing the articulating end 37, wherein 37A shown in phantom, illustrate the placements for said articulating member end 30 and 50 to have the same potential orientation, previously described herein, corresponding with respective member 30, in relation to a plane of potential orientation 99, about the longitudinal axis of the member body 30, herein, for the purpose of giving a user the a wider range of hydrodynamic advantage as would be obvious to those with skill in the art.

What is claimed is:

1. A swim fin or pair of swim fins comprising: a foot pocket adapted to receive a swimmer/users foot with/or without footwear/boot having a forward, aft, top, bottom, plantar, dorsal, and opposing side portions, comprising of elastomeric flexible to rigid and/or composite materials and/or combination thereof: having a plurality of aft foot pocket accessory attach points and a plurality of orifice through holes disposed about said dorsal and plantar portions about said foot pocket, having a plurality of corresponding fixedly attached orifice flaps to said foot pocket orifices disposed in a plantar location about said foot pocket orifices; a fin blade fixedly attached extending outwardly of said foot pocket, comprising of elastomeric flexible to rigid and/or composite materials and/or combination thereof having, a plurality of orifices through holes and corresponding fixedly attached orifice flaps disposed in a plantar fashion about said fin blade orifices, and a plurality of fixedly attached sockets disposed about the outward edges of said fin blade: wherein a plurality of removably attached elongated socketed/non-socketed articulating members are disposed proximal, medially, and laterally extending outwardly of said fin blade edges, comprising of elastomeric flexible to rigid and/or composite materials and/or combination thereof; a webbing removably attached and disposed between outward lateral lengths of said socketed/non-socketed articulating members and fin blade edges proximal, medially, and laterally extending outwardly of said fin blade edges.

2. A swim fin as claimed in claim 1, a foot pocket having a leg bracket accessory removable attached to said aft foot pocket accessory attach points, wherein friction reduction hardware, cable/tendon, cable channeling, comprising of durable materials may be imbedded in said attach point and said leg bracket accessory about said aft foot pocket attach points and said accessory/leg bracket portion.

3. The swim fin as claimed in claim 1, a fin blade, having cabling hardware imbedded in and throughout said foot pocket ending outwardly of said fin blade edges and/or socket sections.

4. The swim fin as claimed in claim 1, a plurality of said articulating members, having cabling hardware and friction reducing hardware imbedded about attach points.

5. The swim fin as claimed in claim 1, a swim fin or pair of swim fins allowing a given swimmer/user, a method of hydrodynamic advantage, employing directional pressure entrapment, relating to horizontal and perpendicular angles of attack relative to a swimmer/user's range of motion.

* * * * *